United States Patent [19]

Hardy et al.

[11] 4,070,204

[45] Jan. 24, 1978

[54] LOW-ENERGY DISHWASHER

[75] Inventors: Albert L. Hardy, Louisville; Edwin R. Braun, Jeffersontown; Edwin M. Hall, Jr., Louisville, all of Ky.

[73] Assignee: General Electric Company, Louisville, Ky.

[21] Appl. No.: 651,519

[22] Filed: Jan. 22, 1976

[51] Int. Cl.[2] ..... B08B 3/00

[52] U.S. Cl. ..... 134/25 A; 134/30; 134/36; 134/57 D; 134/95

[58] Field of Search ..... 134/25 A, 30, 36, 57 D, 134/95, 98, 103, 105, 58 D

[56] References Cited

U.S. PATENT DOCUMENTS

| | | | |
|---|---|---|---|
| 1,161,467 | 11/1915 | Gallup | 134/30 X |
| 2,235,885 | 3/1941 | Johnson | 134/25 A UX |
| 2,359,262 | 9/1944 | Trier et al. | 134/30 X |
| 2,385,264 | 9/1945 | Ferris | 134/25 A |
| 2,619,097 | 11/1952 | Von Bromssen | 134/57 |
| 2,692,604 | 10/1954 | Walker | 134/57 |
| 2,825,665 | 3/1958 | Stoddard | 134/25 |
| 2,990,835 | 7/1961 | Cushing | 134/95 X |
| 3,173,432 | 3/1965 | Dronberger | 134/57 |
| 3,519,796 | 7/1970 | Bebinger | 134/57 X |
| 3,586,011 | 6/1971 | Mazza | 134/57 |
| 3,635,229 | 1/1972 | Jacobs | 134/58 D |
| 3,718,149 | 2/1973 | Mazza | 134/57 D |
| 3,868,968 | 3/1975 | Fuhrmann | 134/58 |

*Primary Examiner*—S. Leon Bashore
*Assistant Examiner*—Marc L. Caroff
*Attorney, Agent, or Firm*—Francis H. Boos

[57] ABSTRACT

A method of cleaning dishes, utilizing a dishwasher apparatus connected to both hot and cold-water lines, the method includes: beginning with one or more cold-water pre-rinses, then providing a hot-water wash, and, finally, concluding with one or more cold-water post-rinses and a last hot-water rinse. Drying then follows with air being circulated through the dishwasher wash chamber. The drying is aided by the residual heat of the dishes from the last rinse.

4 Claims, 1 Drawing Figure

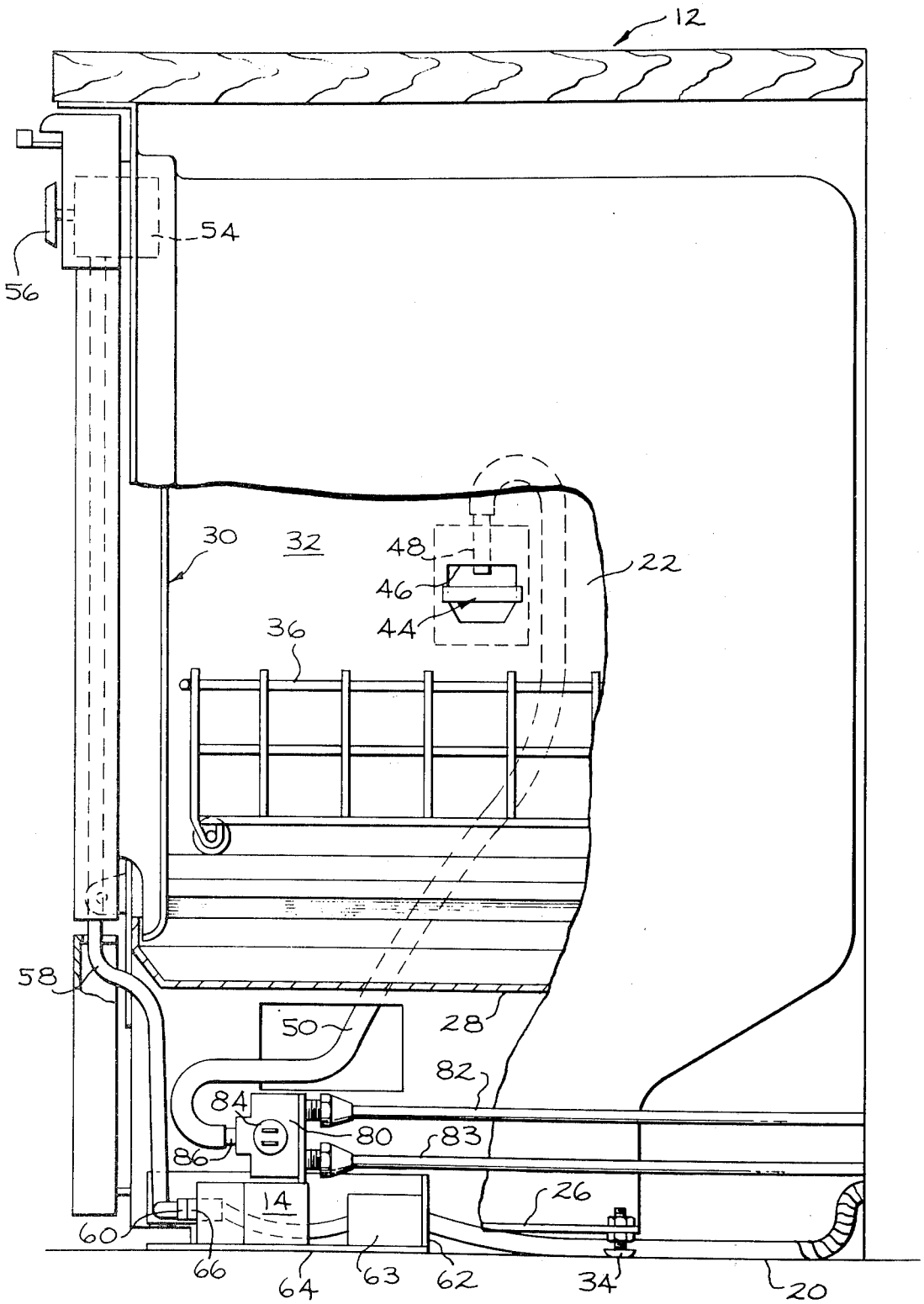
12
54
56
30
32
48
46
44
22
36
58
50
28
82
84
80
83
86
14
26
60
66
64
63
62
34
20

LOW-ENERGY DISHWASHER

BACKGROUND OF THE INVENTION

The concern for energy conservation has affected all areas of modern living, including conserving the energy used by household major appliances. Heretofore, major appliance dishwashers have freely used hot water indiscriminately, in conjunction with electric heating of air for drying dishes after washing.

Conventionally, dishwashers are connected only to a hot-water line in the kitchen. Thus, all washing and rinsing operations must be done with hot water. An analysis of the energy consumption of a typical dishwasher shows that a major portion of the energy consumed in washing the dishes is the energy used for heating the water and for heating air for drying the dishes. The present invention provides for less energy being used by describing a method of washing dishes utilizing a dishwasher connected to both hot and cold-water lines.

Dishwashers using both hot and cold-water have been suggested by, for example, Stoddard-U.S. Pat. No. 2,825,665. However, Stoddard has failed to recognize one of the fundamental problems of having a dishwasher connected to both hot and cold-water sources. That problem is the thermal shock, caused by exposing dishes to water at a first temperature and, then, water at a second, appreciably different temperature. A severe thermal shock will cause the dishes to break. In addition, Stoddard fails to recognize the advantage of having a cold-water rinse, followed by a hot-water wash, cold-water post-rinse, and then a hot-water rinse. Applicant has, however, overcome the defects of Stoddard in the present invention.

SUMMARY OF THE INVENTION

The present invention includes a method of washing dishes utilizing a dishwasher connected to both hot and cold-water sources. The connection is effected by using a multiple inlet, single outlet valve which is adaptable to allow introduction of cold water or hot water or a combination of both into the dishwasher washing chamber. The method of washing dishes disclosed herein is methodically planned so that the dishes inside the wash chamber are never exposed to the next-introduced wash water which is sufficiently different in temperature from the last so as to cause thermal shock and thus cracking of the dishes. Furthermore, the method effects the most desirable washing sequence, namely that of beginning with at least one cold rinse, which avoids baking or cooling soil onto the dishes, followed by a hot wash which maximizes the chemical activity of the dishwashing detergent when the wash concentration is highest, removing the detergent most effectively with a cold-water rinse precedent to at least one hot-water rinse, which, in turn, effects rapid drying of the dishes by increasing convection currents.

More specifically, the invention includes: in a dishwasher having both hot and cold-water inlets, a method of washing dishes arranged in a wash chamber comprising the steps of: introducing a quantity of cold water into said wash chamber; circulating said cold water within said wash chamber in contact with said dishes to effect rinsing of food waste particles therefrom; draining said cold water from said wash chamber; introducng a wash liquid comprising cold and hot water into the wash chamber, beginning with the introduction of cold water in a quantity which constitutes only a minor portion of the wash liquid to be introduced, and simultaneously circulating said minor portion of the wash liquid; continuing to introduce said wash liquid, wherein the liquid now being introduced is comprised of hot water sufficient to constitute the remaining major portion of said wash liquid; sensing the temperature of the resultant wash liquid, and, depending upon the result of said sensing; introducing heat into said wash chamber to effect a temperature increase of said wash liquid to a temperature of at least about 135° F; circulating said wash liquids within said wash chamber in contact with said dishes for a preselected period of time; draining all of said wash liquid from said wash chamber; introducing rinse water comprising hot and cold water into said wash chamber, beginning with the introduction of hot water in a quantity which constitutes only a minor portion of the rinse water to be introduced and simultaneously circulating said minor portion of the rinse water; continuing to introduce said rinse water, wherein the water now being introduced is comprised of cold water sufficient to constitute the remaining major portion of said rinse water; circulating said rinse water within said wash chamber in contact with said dishes for a preselected period of time; draining all of said rinse water from said wash chamber; introducing a rinse water into the wash chamber, beginning with the introduction of cold water in a quantity which constitutes only a minor portion of the rinse water to be introduced and simultaneously circulating said minor portion of the rinse water; continuing to introduce said rinse water, wherein the water now being introduced is comprised of hot water sufficient to constitute the remaining major portion of said rinse water; sensing the temperature of the resultant rinse water and, depending upon the result of said sensing, introducing heat into said wash chamber to effect a temperature increase of said water to a temperature of at least about 135° F; circulating said hot rinse water within said wash chamber in contact with said dishes for a preselected period of time; draining all of said rinse water from said wash chamber; and drying said dishes by circulating air throughout the wash chamber.

The method of this invention has been found to be an effective method of washing dishes to an acceptable standard of cleanliness, using less energy than conventional dishwashers doing the same job.

DESCRIPTION OF THE DRAWINGS

The FIGURE shows a side elevational view, partially in section, of a dishwasher utilized in the method of the present invention, having both hot and cold-water lines connected thereto.

DESCRIPTION OF THE PREFERRED EMBODIMENT

Referring to the FIGURE, dishwasher 12 may be of any suitable type and typically comprises a frame 26 supporting a tub 28 which cooperates with a door 30 to define a wash chamber 32. The frame 26 is supported on the floor 20 by a plurality of screw-adjustable feet 34 (only one shown in the FIGURE).

In the wash chamber 32 are one or more article-receiving racks 36 and spray means (not shown) for circulating and contacting water with the articles (dishes) located on the racks.

Positioned on the side of the tub 28 adjacent an opening 46 therethrough is a fill fitting 48 which carries a fill hose 50. As shown in the FIGURE, the upper end of the fill hose 50 is spaced between the side of the tube 28 and the adjacent cabinet 22 and includes a baffle 44 designed so that liquid introduced into the tub runs down the inside of the cabinet, rather than spraying directly onto the dishes contained on the article racks 36.

The dishwasher 12 is of the automatic type and includes a timer 54 having cams (not shown) for controlling the operation of the various components of the dishwasher 12. An electrical control conduit 58 leads from the timer 54 through the door 30 to a location beneath the tub and terminates in a multi-pronged plug 60, as will be more fully apparent hereinafter. An installation module 14 is provided which includes a generally flat base 64 secured to the floor 20. Attached to base 64 is a frame structure 62 which includes therewithin an electrical terminal box 63. Also secured to frame 62 is a fill valve 80 of the type which allows passage of cold water from cold-water line 82 or hot water from hot-water line 84 or both. Such valves are commercially available from Eaton Controls Division under the tradename "Dole" model. The valve further includes two solenoid operators 84 and a rigid water outlet 86. Fill hose 50 is connected to outlet 86 to allow the water to be transmitted to fill fitting 48. Solenoids 84 are controlled by the timer through connections (not shown). It will accordingly be seen that connection of the control plug 60 to the receptacle 66 provides selective operation of the pump motor and other typically electrically-energized devices in the dishwasher 12 in response to actuation of the timer 54 in a conventional manner.

In operation, the following cycle has been found to produce excellent dishwashing results with a minimum use of energy by the dishwasher described. Valve 80 is open to admit only cold water into the wash chamber for a period of about 1 and ½ minutes. The pump and motor are concurrently actuated and the cold-water wash liquid is circulated in contact with the dishes on the article-receiving rack for about two minutes. The drain valve (not shown) is then opened and the cold water containing food particles is emitted. This portion of the cycle is then repeated. The drain valve is then closed and valve 80 is opened to allow a small proportion of cold water to flow into the dishwasher wash chamber. The amount of cold water introduced is only a minor portion of the total wash water which is to be introduced at this time. Generally, the amount of cold water is an amount sufficient to prime the pump and circulate within the wash chamber. The minor portion of cold water may constitute less than 5 pints of about 20 total pints of wash water to be introduced. The pump and motor continue operation and the water is circulated. A thermostatic sensing device is actuated to sense the temperature of the resultant water. If that temperature is found to be below about 135° F, an electric resistance heating unit (not shown) is actuated to heat the circulating water to a temperature of about 135° F. The pump and motor continue to circulate the hot water in contact with the dishes. Also, detergent is introduced into the hot water at this point to form a hot wash solution. The washing is continued for a period of approximately 20 minutes; then, the drain valve is opened and the hot wash solution is emitted.

After the above-mentioned 20-minute wash period, the entire wash solution is emitted from the dishwasher and the wash chamber is filled with rinse water. The first introduced minor portion of the rinse water is hot water and the remaining major portion is cold water. Simultaneously with the introduction of the rinse water, the wash mechanism operates and rinsing continues for three minutes. After this three-minute period, the wash chamber is drained. A second amount of cold rinse water is introduced and rinsing begins. Rinsing with this second cold rinse water continues for 3 minutes. Thereafter, all of the rinse water is emitted from the wash chamber and a small amount (less than 5 pints) of cold water is introduced. The rinsing begins with the cold-water rinse solution while hot water is being added to a total of about 20 pints. If the temperature of the resultant rinse solution is found to be below about 135° F, heat is added to the wash chamber to bring the temperature to about 135° F. Rinsing continues for a period of time of approximately four minutes. Thereafter, the entire twenty pints of hot rinse water are emitted from the dishwasher and air is allowed to circulate through the wash chamber.

Optionally, a circulating fan may be provided to force air through the wash chamber. However, because the dishes are hot, natural convection currents exist in the wash chamber and provide adequate circulation for drying of the dishes. In the alternative, heated air may be supplied to the dishes at a sacrifice in energy conservation.

The cycle described above has the following features and advantages: The first rinse is effected with cold water and is directed onto the dishes while they are at room temperature. Thus, there is no thermal shock to the dishes, yet cold-water rinsing avoids the problem of cooking or polymerizing protein food soil during the rinse period. Secondly, after the subsequent rinse cycles have further cleaned the dishes, the detergent is introduced with the wash solution which is hot. This ensures maximum chemical reactivity of the full-strength detergent solution. Thirdly, after the rinses, the concentration of food waste particles in the wash is low, thereby providing for maximum washing efficiency. Lastly, the final rinse is with hot water which raises the temperature of the dishes and thereby promotes natural or convection drying thereof.

Having thus described the invention, what is claimed is:

1. A method of washing dishes arranged in a wash chamber of a dishwasher having both hot and cold water inlets for connection to household hot and cold water lines comprising the steps of:

a. introducing a quantity of cold pre-rinse water into said wash chamber;

b. circulating said cold pre-rinse water within said wash chamber in contact with said dishes to effect rinsing of waste food particles therefrom;

c. draining said cold pre-rinse water from said wash chamber;

d. introducing a wash liquid comprising cold and hot water into the wash chamber after draining said cold pre-rinse water, beginning with the introduction of the cold water in a quantity which constitutes only a minor portion of the wash liquid to be introduced, and simultaneously circulating said minor portion of the wash liquid;

e. continuing to introduce said wash liquid, wherein the liquid now being introduced is comprised of hot water and is of sufficient quantity to constitute the major portion of said wash liquid;

f. sensing the temperature of the resultant wash liquid and, depending upon the result of said sensing;

g. introducing heat into said wash chamber to effect a temperature increase of said wash liquid to a temperature of at least about 135° F.;

h. circulating said wash liquid within said wash chamber in contact with said dishes for a preselected period of time;

i. draining all of said wash liquid from said wash chamber;

j. introducing a first rinse water comprising hot and cold water into said wash chamber after draining said wash liquid, beginning with the introduction of hot water in a quantity which constitutes only a minor portion of the first rinse water to be introduced and simultaneously circulating said minor portion of the first rinse water;

k. continuing to introduce said first rinse water wherein the water now being introduced is comprised of cold water and is of sufficient quantity to constitute the major portion of said first rinse water;

l. circulating said first rinse water within said wash chamber in contact with said dishes for a preselected period of time;

m. draining all of said first rinse water from said wash chamber;

n. introducing a second rinse water comprising cold and hot water into the wash chamber after draining said first rinse water, beginning with the introduction of cold water in a quantity which constitutes only a minor portion of the second rinse water to be introduced and simultaneously circulating said minor portion of the second rinse water;

o. continuing to introduce said second rinse water, wherein the water now being introduced is comprised of hot water and is of sufficient quantity to constitute the major portion of said second rinse water;

p. sensing the temperature of the resultant second rinse water and, depending upon the result of said sensing;

q. introducing heat into said wash chamber to effect a temperature increase of said second rinse water to a temperature of at least about 135° F.;

r. circulating said hot second rinse water now at a temperature of about 135° F. within said wash chamber in contact with said dishes for a preselected period of time;

s. draining all of said second rinse water from said wash chamber; and t. drying said dishes after draining said second rinse water by circulating air throughout the wash chamber.

2. The method of claim 1 further including repeating steps (a), (b) and (c) prior to step (d).

3. The method of claim 1 wherein detergent is added to said wash liquid following step (g) and prior to step (h).

4. The method of claim 1 further including the following additional steps following step (m) and prior to step (n);

a. introducing a third rinse water comprising cold water into said wash chamber;

b. circulating said third rinse water within said wash chamber in contact with said dishes for a preselected period of time; and c. draining all of said third rinse water from said wash chamber.

* * * * *